US008573750B2

(12) United States Patent
Hoisington et al.

(10) Patent No.: US 8,573,750 B2
(45) Date of Patent: Nov. 5, 2013

(54) SHORT CIRCUIT PROTECTION FOR INKJET PRINTHEAD

(75) Inventors: Paul A. Hoisington, Hanover, NH (US); Andreas Bibl, Los Altos, CA (US); Mats G. Ottosson, Cupertino, CA (US); Deane A. Gardner, Cupertino, CA (US)

(73) Assignee: FUJIFILM Corporation, Tokyo (JP)

( * ) Notice: Subject to any disclaimer, the term of this patent is extended or adjusted under 35 U.S.C. 154(b) by 653 days.

(21) Appl. No.: 12/607,778

(22) Filed: Oct. 28, 2009

(65) Prior Publication Data

US 2010/0141713 A1 Jun. 10, 2010

Related U.S. Application Data

(60) Provisional application No. 61/109,880, filed on Oct. 30, 2008.

(51) Int. Cl.

| | |
|---|---|
| ***B41J 2/045*** | (2006.01) |
| ***B41J 2/04*** | (2006.01) |
| ***H01H 85/04*** | (2006.01) |

(52) U.S. Cl.
USPC ..... 347/68; 347/54; 337/290

(58) Field of Classification Search
USPC ..... 347/57–59
See application file for complete search history.

(56) References Cited

U.S. PATENT DOCUMENTS

| | | | | |
|---|---|---|---|---|
| 5,694,156 | A * | 12/1997 | Hoisington et al. | 347/7 |
| 7,732,893 | B2 * | 6/2010 | Iyer et al. | 257/529 |
| 2001/0010443 | A1 * | 8/2001 | Blom | 310/328 |
| 2003/0142155 | A1 * | 7/2003 | Umeda | 347/9 |
| 2004/0085405 | A1 * | 5/2004 | Baek | 347/59 |
| 2005/0041073 | A1 | 2/2005 | Fontaine et al. | |
| 2005/0099467 | A1 | 5/2005 | Bibl et al. | |
| 2007/0008382 | A1 | 1/2007 | Hatsui et al. | |
| 2010/0148628 | A1 * | 6/2010 | Pauer et al. | 310/317 |
| 2011/0115852 | A1 * | 5/2011 | Bibl et al. | 347/50 |

FOREIGN PATENT DOCUMENTS

| | | | |
|---|---|---|---|
| JP | 02291184 | A * | 11/1990 |
| JP | 2003-154647 | | 5/2003 |
| JP | 2004-148802 | | 5/2004 |
| JP | 2007-038667 | | 2/2007 |

OTHER PUBLICATIONS

"Application-specific integrated circuit," [online]; [Retrieved on Oct. 27, 2009]; Retrieved from the Internet URL: http://en.wikipedia.org/wiki/Application-specific_integrated_circuit, 7 pages.

Japanese Office Action in Japanese Application No. 2009-249267, mailed Jun. 10, 2013, 4 pages (with English translation).

* cited by examiner

*Primary Examiner* — Lisa M Solomon
(74) *Attorney, Agent, or Firm* — Fish & Richardson P.C.

(57) ABSTRACT

Systems and apparatus for ejecting fluid. A fluid injection apparatus includes a fluid ejector unit for ejecting a droplet of fluid, an integrated circuit, and a conductive trace electrically coupling the fluid ejector unit and the integrated circuit. A portion of the conductive trace includes a fuse.

7 Claims, 7 Drawing Sheets

SHORT CIRCUIT PROTECTION FOR INKJET PRINTHEAD

CROSS-REFERENCE TO RELATED APPLICATIONS

This application claims the benefit of U.S. Provisional Application No. 61/109,880, filed Oct. 30, 2008, and is incorporated herein by reference.

BACKGROUND

The subject matter of this specification is related generally to fluid ejectors, e.g., inkjet printheads.

An inkjet printhead can have multiple piezoelectrically controlled ink ejectors, each including a pumping chamber connected to a nozzle. The ink ejectors can be driven by an application specific integrated circuit (ASIC). The ASIC applies a voltage to the piezoelectric material, causing the piezoelectric material to deflect. The deflection actuates the pumping chamber and causes ejection of ink from the associated nozzle.

The piezoelectrically controlled ink nozzles, along with the ASICs, can be packed into a relatively small area. Because of the small area and defects or deterioration of electrical paths in the ASICs and the connections between the ASICs and the piezoelectric materials, electrical shorts, and thus overcurrent conditions, can occur, which can disable the ink nozzles.

SUMMARY

In general, one aspect of the subject matter described in this specification can be embodied in apparatuses that include a fluid ejector unit for ejecting a droplet of fluid, an integrated circuit, and a conductive trace electrically coupling the fluid ejector unit and the integrated circuit, where a portion of the conductive trace includes a fuse.

Implementations can include one or more of the following features. The fluid ejector unit can include an actuator supported on the substrate. The actuator can include a first electrode, a second electrode, and a piezoelectric material between the first electrode and second electrode. The fuse can be formed on the piezoelectric material. The fluid ejector unit can include a substrate supporting the actuator. The first electrode can be nearer to the substrate than the second electrode, and the conductive trace can be connected to the second electrode. The fuse can be immediately adjacent the second electrode. The fuse can be spaced apart from the second electrode, and a portion of the conductive trace can connect the fuse to the second electrode. The conductive trace, including the fuse, can be made of ti-tungsten. The thickness of the conductive trace, including the fuse, can be about 1000 angstroms. The fuse can have a length of about 28 microns and a width of about 5 microns. The fuse can include a constricted portion of the conductive trace. The apparatus can include a conductive layer laid over the conductive trace, where a portion of the conductive layer over the fuse is omitted. The conductive layer can be made of gold or copper.

In general, another aspect of the subject matter described in this specification can be embodied in a system that includes a printhead, where the printhead includes a fluid ejector unit for ejecting a droplet of fluid; an integrated circuit for driving the droplet ejector; and an electrode electrically coupling the droplet ejector and the integrated circuit, where the electrode includes a fuse portion; and a flex circuit for transmitting data to the integrated circuit of the printhead.

Particular embodiments of the subject matter described in this specification can be implemented to realize one or more of the following advantages. Failure of a droplet ejector nozzle caused by overcurrent conditions can be prevented from propagating and disabling further droplet ejectors. The apparatus, combined with an imaging algorithm that compensates for isolated inoperative droplet ejector nozzle, can eliminate the need to replace printheads in some situations.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
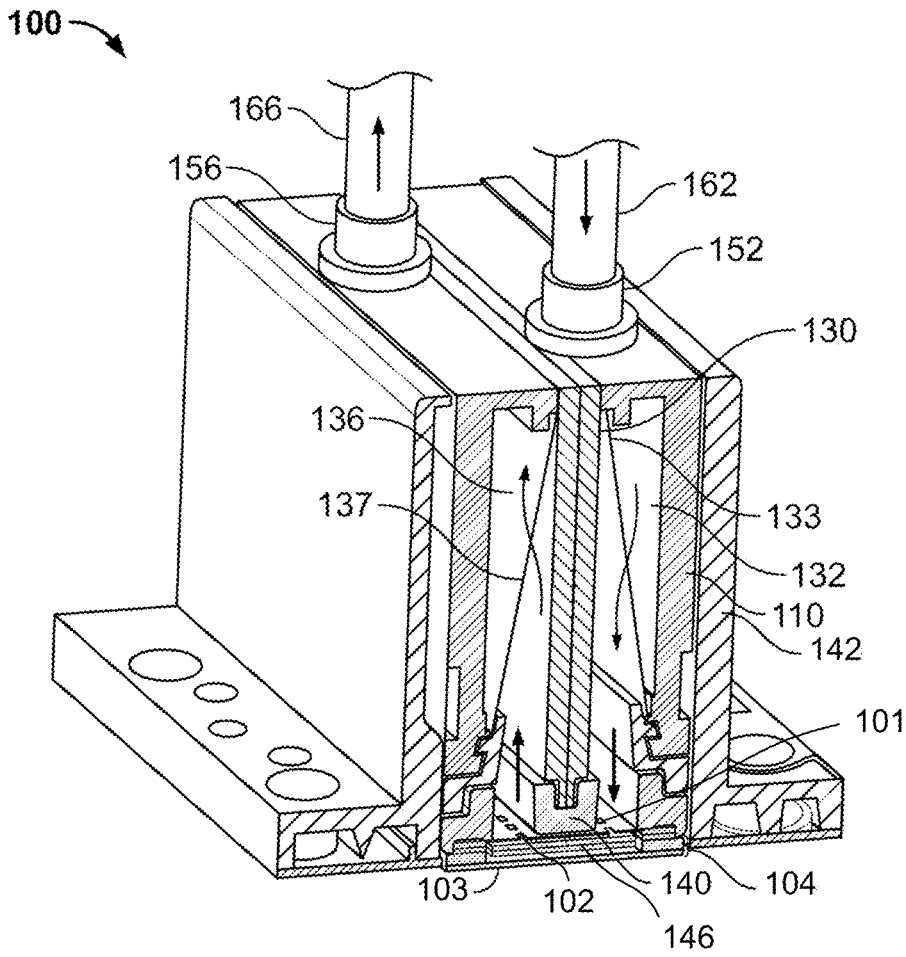
FIG. 1 is schematic perspective sectional view of a housed fluid ejector.

A fluid ejector is described herein. An exemplary fluid ejector is shown in FIG. 1. The fluid ejector 100 includes a fluid ejection module, e.g., a quadrilateral plate-shaped printhead module, which can be a die 103, fabricated using semiconductor processing techniques. Fluid ejection modules are also described in U.S. Pat. No. 7,052,117, which is incorporated by reference herein. The fluid ejected from the fluid ejector 100 can be ink, but the fluid ejector 100 can be suitable for other liquids, e.g., biological liquids or liquids for forming electronic components.

Each fluid ejector 100 can also include a housing 110 to support and provide fluid to the die 103, along with other components such as a mounting frame 142 to connect the housing 110 to a print bar, and a flex circuit (not shown in FIG. 1) to receive data from an external processor and provide drive signals to the die 103. The housing 110 can be divided by a dividing wall 130 to provide an inlet chamber 132 and an outlet chamber 136. Each chamber 132 and 136 can include a filter 133 and 137. Tubing 162 and 166 that carries the fluid can be connected to the chambers 132 and 136, respectively, through apertures 152 and 156. The dividing wall 130 can be held by a support 140 that sits on an interposer assembly 146 above the die 103.

A fluid ejection assembly, that includes the die 103 and the optional interposer assembly 146, includes fluid inlets 101 and fluid outlets 102 for allowing fluid to circulate from the inlet chamber 132, through the die 103, and into the outlet chamber 136. A portion of the fluid passing through the die 103 is ejected from the nozzles.

The fluid ejector 100 can include a flexible printed circuit or flex circuit. The flex circuit can be configured to electrically connect the fluid ejector 100 to a printer system (not shown). The flex circuit is used to transmit data, such as image data and timing signals, from an external processor of the printer system to the die 103 for driving fluid ejection elements on the die 103. The flex circuit can also be used to connect a thermistor for fluid temperature control.

Figure 2:
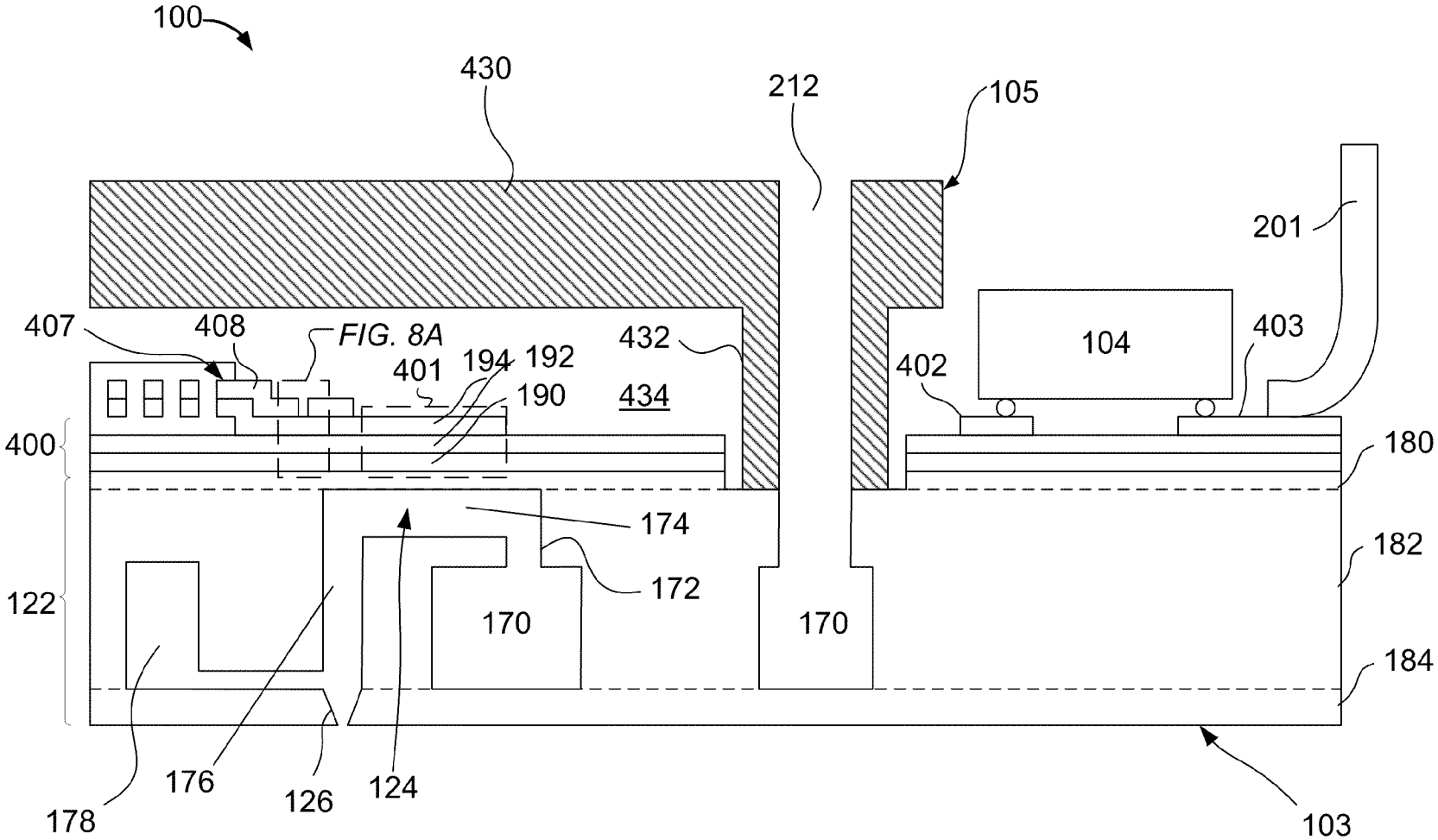
FIG. 2 is a schematic cross-sectional view of a die and an interposer.

Referring to FIG. 2, the die 103 can include a substrate 122 in which are formed fluid flow paths 124 that end in nozzles 126 (only one flow path is shown in FIG. 2). A single flow path 124 includes an ink feed 170 (the two areas labeled 170 in FIG. 2 can be connected by a passage extending out of the page), an ascender 172, a pumping chamber 174, and a descender 176 that ends in the nozzle 126. The flow path 124 can further include a recirculation path 178 so that ink can flow through the flow path 124 even when fluid is not being ejected.

The substrate 122 can further include a flow-path body 182 in which the flow path 124 is formed by semiconductor processing techniques, e.g., etching, a membrane 180, such as a layer of silicon, which seals one side of the pumping chamber 174, and a nozzle layer 184 through which the nozzle 126 is formed. The membrane 180, flow path body 182 and nozzle layer 184 can each be composed of a semiconductor material (e.g., single crystal silicon). The membrane 180 can be relatively thin, such as less than 25 μm, for example about 12 μm.

The die 103 also includes an actuator structure 400 with individually controllable actuators 401 supported on the substrate 122 for causing fluid to be selectively ejected from the nozzles 126 of corresponding flow paths 124 (only one actuator is shown in FIG. 2). Each flow path 124 with its associated actuator 401 (fluid ejection element) provides an individually controllable MEMS fluid ejector unit.

In some embodiments, activation of the actuator 401 causes the membrane 180 to deflect into the pumping chamber 174, forcing fluid out of the nozzle 126. For example, the actuator 401 can be a piezoelectric actuator, and can include a lower conductive layer 190, a piezoelectric layer 192, and a patterned upper conductive layer 194. The piezoelectric layer 192 can be between e.g. about 1 and 25 microns thick, e.g., about 8 to 18 microns thick. Alternatively, the fluid ejection element can be a heating element.

Figure 3:
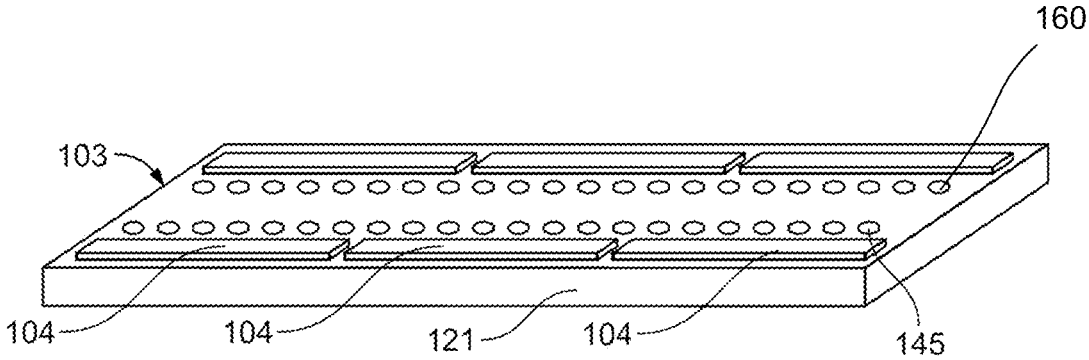
FIG. 3 is a schematic perspective view of a die on which integrated circuit elements are mounted.

Referring to FIGS. 2 and 3, the fluid ejector 100 further includes one or more integrated circuit elements 104 configured to provide electrical signals for control of ejection of fluid from the die 103 through nozzles located on the underside of the die 103. The integrated circuit element 104 can be a microchip, other than the die 103, in which integrated circuits are formed, e.g., by semiconductor fabrication and packaging techniques. Thus, the integrated circuits of the integrated circuit element 104 can be formed in a separate semiconductor substrate from the substrate of the die 103. However, the integrated circuit element 104 can be mounted directly onto the die 103.

Referring to FIG. 2, in some embodiments, the fluid ejection assembly of the fluid ejector 100 includes a lower interposer 105 to separate the fluid from the electrical components on the die 103 and/or the integrated circuit element 104. Passage 212 through the lower interposer 105 can allow for routing of fluid from/to a somewhat centralized location of chambers (not shown) in the housing of the fluid ejector 100 to/from fluid inlets and fluid outlets (not shown) that are closer to an edge of the die 103.

Figure 5:
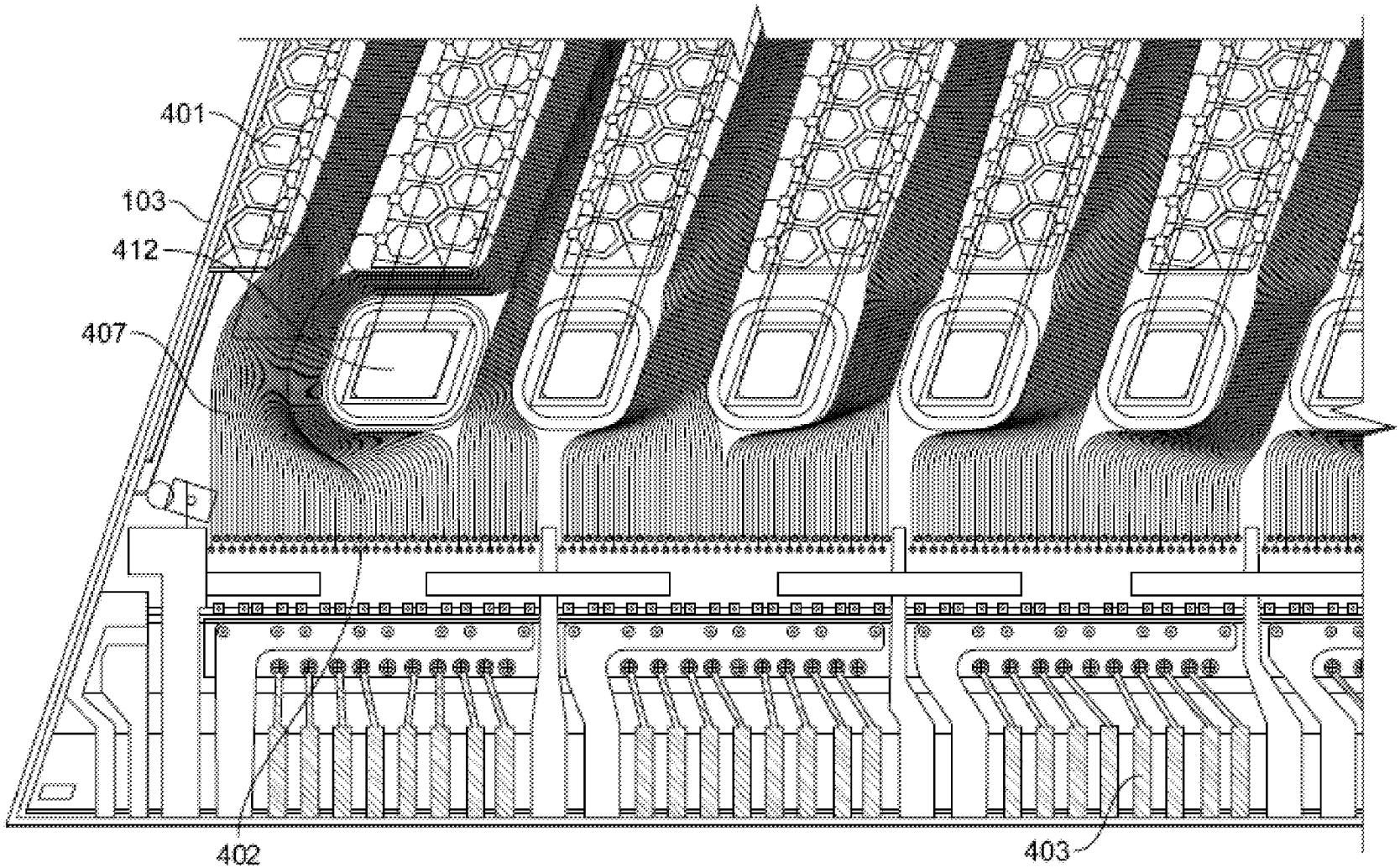
FIG. 5 is a plan view of a die with circuitry.
Figure 6:
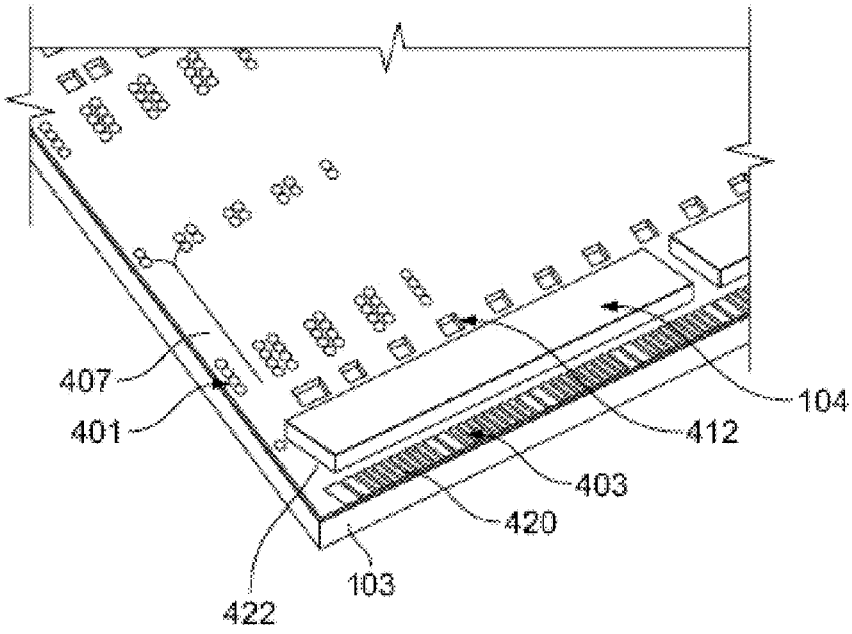
FIG. 6 is a simplified perspective view of a die with integrated circuit elements.

A plan and perspective partial view of an exemplary die having circuitry is shown in FIGS. 5 and 6, respectively. The multiple actuators 401 on the die 103 can be disposed in columns (FIG. 6 omits many of the actuators for simplicity). The actuators 401 shown in FIGS. 5 and 6 are piezoelectric elements, e.g., each actuator includes a piezoelectric layer between two electrodes. For each actuator 401, an electrode, e.g., the top electrode 194 (FIG. 2), can be connected to a corresponding input pad 402 by way of a conductive trace 407 that is also located on the die 103 (FIG. 6 illustrates only a single trace 407 for simplicity). Portions of the traces 407 can extend between the columns of actuators 401.

In some embodiments, a fluid inlet 412 is formed at the end of a column of actuators 401. At an opposite end of the column, a fluid outlet (not shown) can be formed in the top of the die 103. A single fluid inlet and fluid outlet pair can serve one, two, or more columns of actuators 401. The passage 212 through the lower interposer 105 fluidically connects the inlet 101 to the inlet 412 of the die 103, and the fluid outlet of the die 103 to the outlet 102. The die 103 further includes conductive input traces 403 arranged along one or more edges of the die 103. The traces 403 can have a pitch of about 40 microns or less, e.g., 36 micron pitch or 10 micron pitch. A flex circuit 201 (see FIG. 2) can be bonded into the input traces 403 of the die 103. For example, the flex circuit 201 can be connected to the distal ends 420 of the traces 403 at the edge of the die 103 (see FIG. 6). The bonding can be performed, for example, with paste, e.g., Non Conductive Paste (NCP) or Anisotropic Conductive Paste (ACP).

As shown in FIGS. 2, 3 and 6, the integrated circuit elements 104 can be mounted to the die 103 in a row extending in an elongated area between the input traces 403 and the inlets 412 or outlets. For example, a first row of integrated circuit elements 104 can be mounted to the die 103 in a first row extending in an elongated area between the input traces 403 on one edge of the die 103 and the inlets 412, and a second row of integrated circuit elements 104 can be mounted to the die 103 in a row extending in an elongated area between the input traces 403 on the opposite edge of the die 103 and the outlets.

A perspective view of an exemplary die 103 with integrated circuit elements 104 mounted thereon is shown in FIG. 3. As noted above, the integrated circuit element 104 can be a separately fabricated element, e.g., a separate die, that is mounted on the die 103. In some implementations, the integrated circuit element 104 is an application-specific integrated circuit (ASIC) element. The integrated circuit element 104 can be a chip that can include, for example a die, packaging, and leads. The leads connecting the bond pads of the integrated circuit element 104 to electrical traces on the die 103 can be solder bumps (see FIG. 2) or wire bonds. For example, the leads can be gold bumps electroplated directly onto an aluminum bonding pad of the integrated circuit element 104. They can also be copper pillar bumps with a solder cap electroplated directly onto electrical pads of the integrated circuit element 104.

Figure 7:
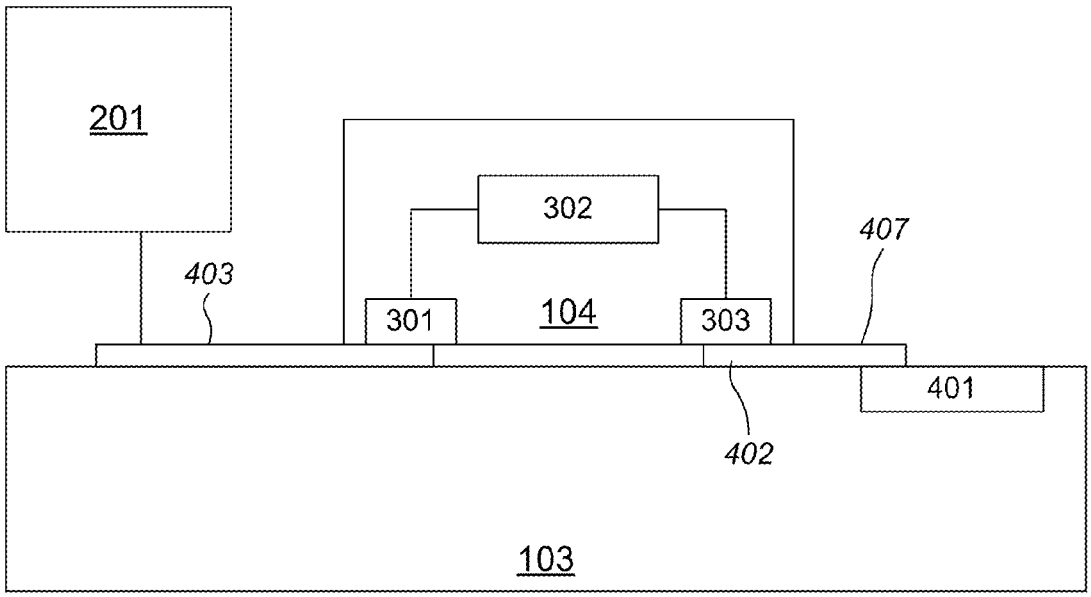
FIG. 7 is a schematic diagram of the electric connections between the flex circuit, die and integrated circuit elements.

The integrated circuit element 104 is configured to provide signals to control the operation of the actuators 401, as shown in FIG. 7. For example, integrated switching elements 302, e.g., transistors, in the integrated circuit element 104 can be connected to actuators 401 on the die 103 with electrical contacts and leads. Thus, when a signal is sent from the flex circuit 201 to the input trace 403 on the die 103, it can be transmitted to an input pad 301 on the integrated circuit element 104, processed on the integrated circuit element 104, such as at the transistor 302, and output at an output pad 303 to the input pad 402 on the die 103, which is connected by the input trace 407 to drive the actuator 401. In some implementations, the integrated circuit element 104 also includes one or more diodes.

The integrated circuit element 104 shown in FIG. 6 includes input pads 301 (see FIG. 7) that are connected to the input traces 403 on the die 103. For example, the input pads 301 on the integrated circuit elements 104 can be connected to the proximal ends 422 of the input traces 403, which are closer to a center of the die 103 than distal ends 420 of the input traces 403. The input pads 301 and input traces 403 can be connected using non-conductive paste (NCP), anisotropic conductive paste (ACP), or solder bumps on the integrated circuit elements 104. The input pads 301 of the integrated circuit element 104 can be on the bottom surface of the integrated circuit element 104 to provide better electrical connection with the input traces 403 of the die 103.

As shown in FIG. 7, the integrated circuit element 104 also includes output pads 303 that are connected to the input pads 301 of the integrated circuit element 104 through one or more integrated switching elements 302. Additionally, the output pads 303 on the integrated circuit element 104 are electrically connected to the input pads 402 of the die 103. The output pads 303 can be connected to the input pads 402 using NCP, ACP, or solder bumps on the integrated circuit elements 104. The output pads 303 on the integrated circuit element 104 can be on the bottom surface of the integrated circuit element 104 to provide better electrical connection with the input pads 402 on the die 103.

As noted, the integrated circuit element 104 includes integrated switching elements 302. Each switching element acts as an on/off switch to selectively connect the drive electrode of one MEMS fluid ejector unit to a common drive signal source. The common drive signal voltage is carried on one or more integrated circuit input pads 301, traces 403, and corresponding traces on flex circuit 201. The integrated switching elements 302 are connected to the input pads 301 of the integrated circuit element 104 and the output pads 303 of the integrated circuit element 104. Thus, the integrated circuit element 104 includes connections that are made internally, such as between the input pads 301, the integrated switching element 302, and the output pad 303.

One integrated circuit element 104 can include multiple integrated switching elements 302, such as 256 integrated switching elements. The number of integrated switching elements 302 can be the same as the number of actuators on the die 103 or a fraction thereof. Further, in some embodiments, the number of integrated switching elements 302 is equal to the number of input pads 301 on the integrated circuit 104. In some embodiments, each integrated switching element 302 is in electrical communication with more than one output pad 303.

Returning to FIG. 2, the fluid ejector includes an interposer 105 to separate the fluid ejection elements 401 from the external environment. The interposer 105 can be made of a material with the same or similar coefficient of thermal expansion as the die 103, such as silicon, in order to prevent stress between the two components. Although it is not required, the fluid ejector can further include an upper interposer (not shown).

As shown in FIG. 2, the lower interposer 105 can include a main body 430 and flanges 432 that project down from the main body 430 to contact the die 103 in a region between the integrated circuit elements 104 and the actuators 401, e.g., over the inlets 412 and outlets. In particular, there can be a flange 432 for each inlet 412 and outlet, with one or more passages (e.g., passage 212) extending through the flanges 432. The flanges 432 hold the main body 430 over the die 103 to form a cavity 434. This prevents the main body 430 from contacting and interfering with motion of the actuators 401. In some implementations (shown in FIG. 2), an aperture is formed through the membrane layer 180, as well as the layers of the actuator 401 if present, and an adhesive bond bonds the flange 432 to the flow-path body 182. Alternatively, the flange 432 can contact the membrane 180 or another layer that covers the substrate 122. In addition, in some implementations, some flanges extend to contact the die 103 over the traces 407 between the rows of actuators 401.

Figure 4:
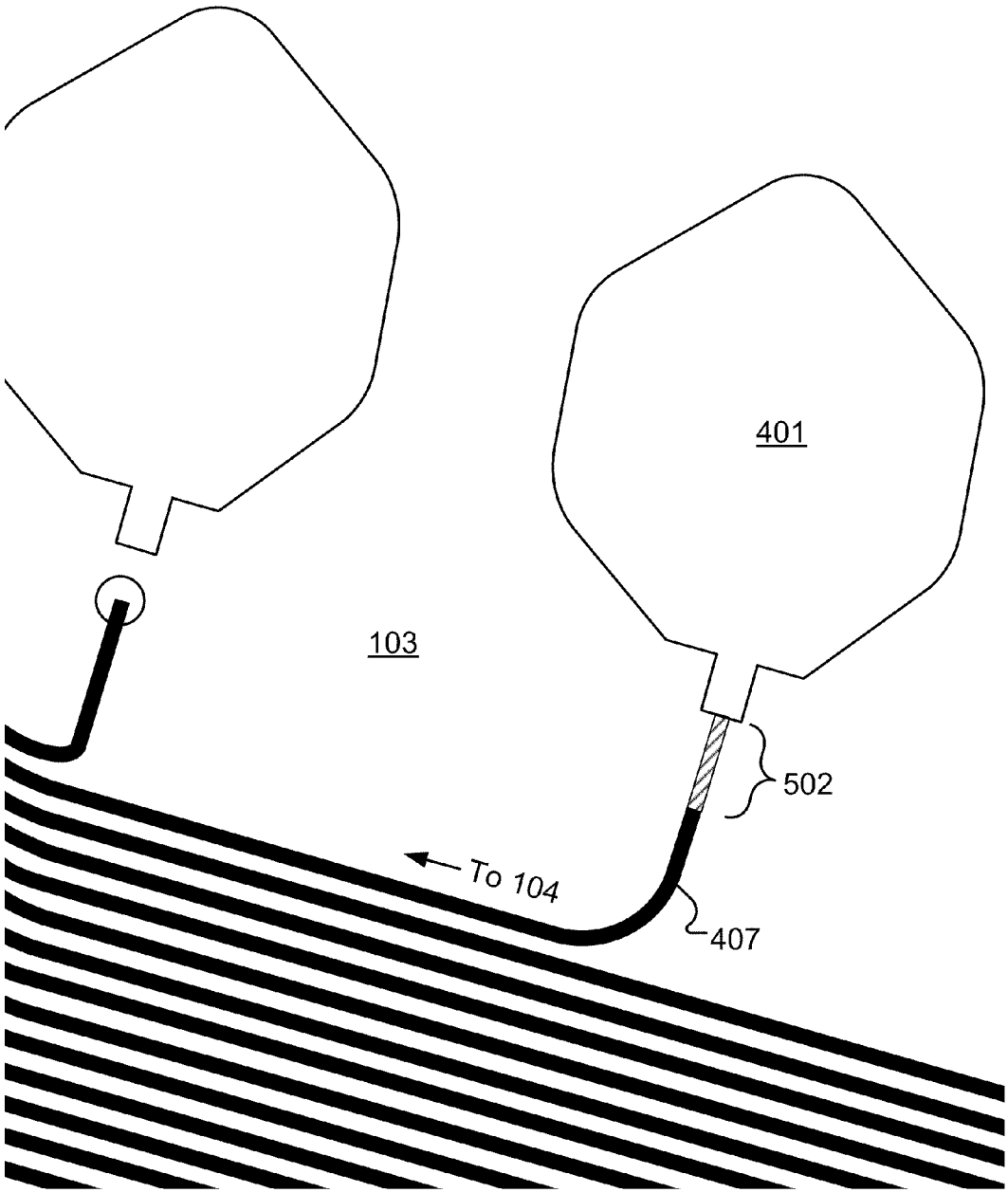
FIG. 4 is a schematic view of a trace leading to an actuator.

FIG. 4 is a schematic view of a trace leading to an actuator. FIG. 4 shows a trace 407 leading to an actuator 401 from integrated circuit 104. In some implementations, the trace 407 can include an upper trace layer 408, such as a conductive material (e.g., gold, copper), layered above a lower trace layer. The lower trace layer can be an extension of the top electrode 194 extending from the actuator 401, e.g., the lower trace layer and the top electrode can be formed from the same layer 194 (shown in FIG. 2).

Along the path of the trace 407 to the actuator 401 is a fuse 502. The fuse 502 can be located anywhere along the trace 407 between the actuator 401 and the integrated circuit 104. In some implementations, the fuse 502 can be in close lateral proximity to the actuator 401, e.g., adjacent or within 200 microns, e.g., within 100 microns, e.g., within 50 microns, of the actuator 401. In some implementations, the fuse 502 is a constriction of the lower trace layer, e.g., a constriction of an extension of the top electrode 194 that is not layered over by the upper trace layer 408. The fuse 502 can be exposed (i.e., not have any layer over it). Alternatively, the fuse 502 can be formed of conductive material different than that of the lower trace layer 194.

In some implementations (shown in FIGS. 2 and 8A), the upper trace layer 408 is deposited on both sides of the fuse 502. Thus, there is a material, made of the same material as the upper trace layer 408, on the end of the fuse 502 opposite to the portion of the trace 407 that leads to the integrated circuit 104. In some implementations (shown in FIG. 2), the upper trace layer 408 is deposited over a portion of the trace 407 between the fuse 502 and the actuator area 401. In some implementations (not shown), the fuse 502 is adjacent to the actuator area 401 and the upper trace layer 408 extends over the top electrode 194 in the actuator area 401.

In some other implementations (shown in FIG. 2) the upper trace layer 408 does not extend over the top electrode 194 in the actuator area 401, in order to reduce the mass of material over the membrane 180 and thus reduce the drive voltage needed to actuate the membrane 180. In such implementations, assuming that the fuse 502 is spaced from the actuator area 401, the upper trace layer 408 can still be deposited over the portion of the trace 407 between the fuse 502 and the actuator area 401.

In some implementations (shown in FIG. 8C), the upper trace layer 408 is not deposited on the side of the fuse 502 opposite to the portion of the trace 407 leading to the integrated circuit 104. For example, the fuse 502 can be immediately adjacent the actuator area 401 (that is not covered by the upper trace layer 408), or the fuse can be spaced from the actuator area 401 but the portion of the trace 407 between the fuse 502 and the actuator area 401 simply lacks the upper trace layer 408.

The fuse 502 can blow if an excessive amount of current flows through the fuse 502 (i.e., an overcurrent condition). For example, if a short circuit between the electrodes 194 and 190 occurs, leading to an excessive current flow through the top electrode 194 and the fuse 502 to the trace 407, the fuse 502 can blow or open. The blowing of the fuse 502 disables the actuator 401 and can prevent the overcurrent condition from spreading and disabling other actuators.

Figure 8A:
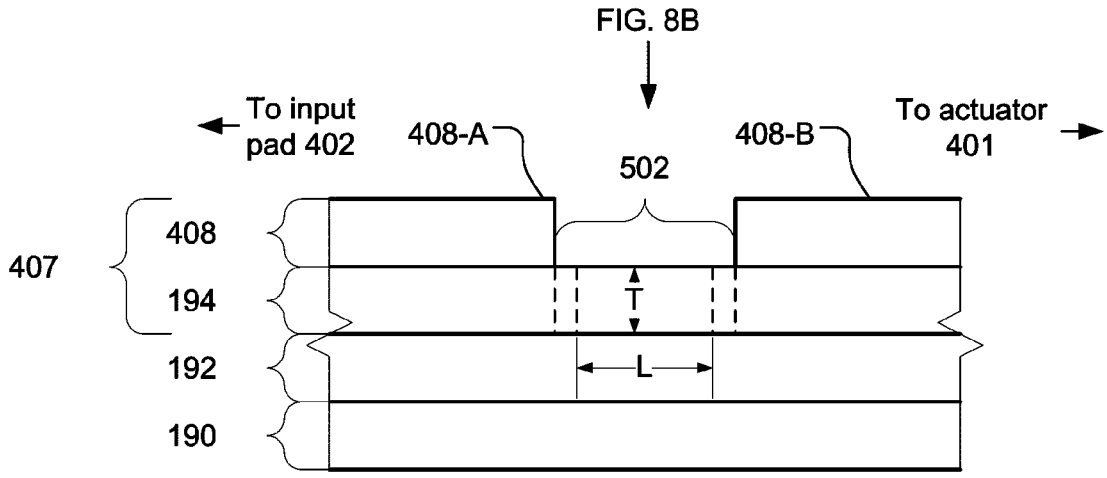
FIG. 8A is a cross-section view of an example trace with a fuse.
Figure 8B:
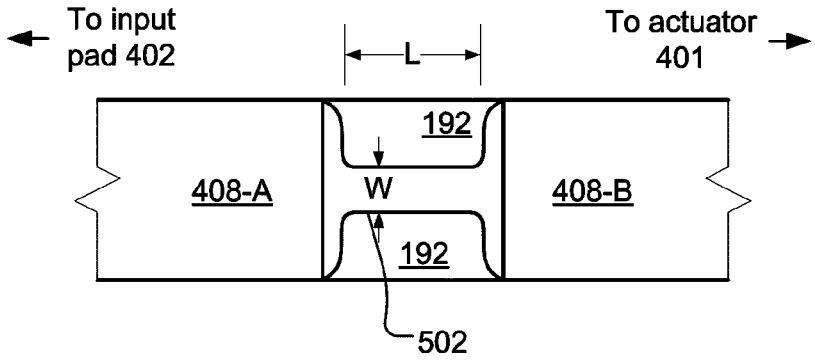
FIG. 8B is a schematic view of the example trace of FIG. 8A.

FIG. 8A is a cross-section view of an example a trace with a fuse. FIG. 8A is a magnified view of an indicated portion of the cross-sectional view of FIG. 2. FIG. 8B is a schematic view of the example trace of FIG. 8A. In FIG. 8A, for convenience and ease of illustration, only the electrodes (conductive layers) 194 and 190, piezoelectric layer 192, and trace 407, including upper trace layer portions 408-A and 408-B on opposite sides of the fuse 502, are shown. The fuse 502 can be a constriction of a portion of the top electrode 194. The portion of the upper trace layer 408 that is over the fuse 502 can be removed or omitted. In some implementations, the upper trace layer portions 408-A and 408-B extend on opposite sides of the fuse 502. In some other implementations, as shown in FIG. 8C, upper trace layer portion 408-B is omitted; the upper trace layer 408 terminates at the fuse 502.

Figure 8C:
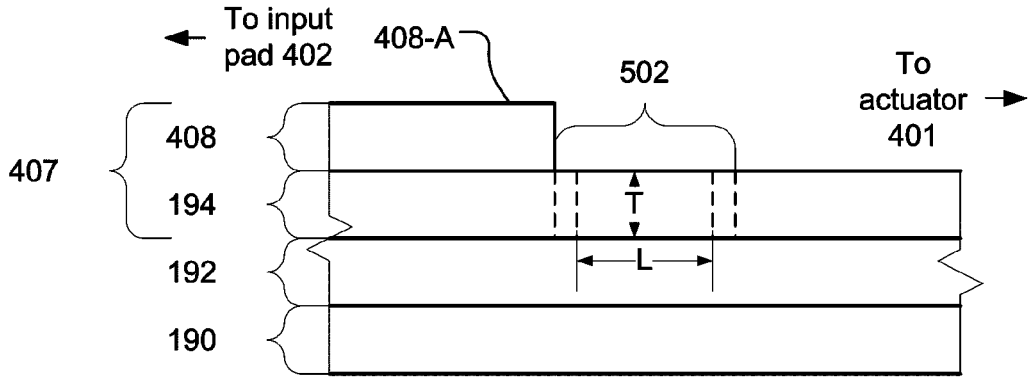
FIG. 8C is a cross-section view of another example trace with a fuse.

In some implementations, and as shown in FIGS. 8A-8C, the fuse 502 (being part of top electrode 194) is laid over, e.g., deposited directly on, the piezoelectric layer 192. Thus, the piezoelectric layer 192 can serve as a substrate for the fuse 502. Piezoelectric material (e.g., lead zirconate titanate) has thermal conductivity properties that allows a fuse of reasonable size to open or blow under excessive currents (e.g., ~100 mA) and to not heat excessively under operating currents of about 10 mA. Further, the piezoelectric material does not form carbon tracks when the fuse blows and heats the piezoelectric material. In some other implementations, the fuse 502 can be on top of a silicon or polymer layer or substrate, or on top of an insulator layer over a silicon, polymer or piezoelectric layer or substrate. For example, the fuse 502 can be a constricted portion of the top electrode 194 laid over a silicon or polymer material added to an etched die 103 or an etched bottom electrode 190 and piezoelectric layer 192.

In some implementations, the top electrode 194 is made of ti-tungsten and has a thickness T of about 1000 angstroms, which gives the top electrode 194 a sheet resistance of about 7 ohms/square. The fuse portion 502 of this top electrode 194 has a width W and a length L. In some implementations, the width W is about 5 microns and the length L is about 28 microns. In some other implementations, width W of the fuse 502 can be more or less than 5 microns (but still less than the width of the top electrode 194, depending on the desired current at which the fuse 502 is to blow. More generally, the width W and length L can vary depending on the implementation based on one or more parameters, such as operating currents and maximum acceptable current limits, trace electrical conductivity, substrate thermal diffusivity, etc. The trace 407 can be of a thickness that is suited to provide relatively low resistivity.

As described above, the integrated circuit 104 can include a transistor 302. In some implementations, the transistor 302 is a field-effect transistor (FET). If an overcurrent condition occurs, the overcurrent can flow thorough the FET. The FET can be used to limit the current that can flow through the integrated circuit 104, so that the fuse 502 can have sufficient time to blow. For example, the maximum current can be limited to the gate transconductance times the gate voltage. In some implementations, the transistor current limit is about 100 to 150 mA, which the transistor 302 can withstand for several seconds, giving the fuse 502 sufficient time to blow.

In some implementations, the integrated circuit 104 includes a diode. The diode can be coupled to the source and drain of the transistor 302 and to the output pad 303. Current can flow through the transistor 302 or the diode. In these implementations, the current can be limited by the resistance of the fuse 502. For example, for a 10-volt short circuit, a 40 ohm fuse have a current limit of about 0.25 A. Too high of a fuse resistance, however, can reduce the velocity of fluids ejected by the fluid ejector 100; the capacitance in the fluid ejector and the fuse resistance can round off the driver waveform.

Particular embodiments of the subject matter described in this specification have been described. Other embodiments are within the scope of the following claims.

What is claimed is:

1. An apparatus comprising:

a fluid ejector unit for ejecting a droplet of fluid, the fluid ejector unit comprising an actuator;

an integrated circuit; and a conductive trace electrically coupling the fluid ejector unit and the integrated circuit, a portion of the conductive trace comprising a fuse, wherein:

the conductive trace and the fuse are configured such that blowing of the fuse disables the fluid ejector unit;

the integrated circuit is configured to generate an actuating current when a droplet is to be ejected, and that when the fuse is not blown the actuating current flows through the fuse to the actuator; and when the fuse is blown, the actuating current is prevented from reaching the actuator, wherein:

the fluid ejector unit includes a substrate supporting the actuator, the actuator including a first electrode, a second electrode, and a piezoelectric material between the first electrode and second electrode, the first electrode is nearer to the substrate than the second electrode and the conductive trace is connected to the second electrode, and the fuse is immediately adjacent the second electrode.

2. The apparatus of claim 1, wherein the conductive trace, including the fuse, is made of ti-tungsten.

3. The apparatus of claim 2, wherein the thickness of the conductive trace, including the fuse, is about 1000 angstroms.

4. The apparatus of claim 3, wherein the fuse has a length of about 28 microns and a width of about 5 microns.

5. The apparatus of claim 1, wherein the fuse comprises a constricted portion of the conductive trace.

6. An apparatus comprising:

a fluid ejector unit for ejecting a droplet of fluid;

an integrated circuit;

a conductive trace electrically coupling the fluid ejector unit and the integrated circuit, a portion of the conductive trace comprising a fuse, and a conductive layer laid over the conductive trace, wherein:

a portion of the conductive layer over the fuse is omitted, and the fuse comprises a constricted portion of the conductive trace.

7. The apparatus of claim 6, wherein the conductive layer is made of gold or copper.

* * * * *